US005576678A

United States Patent [19]

Saunders

[11] Patent Number: 5,576,678

[45] Date of Patent: Nov. 19, 1996

[54] APPARATUS AND METHOD FOR MAGNETIC PROXIMITY SWITCH ALTERATION

[76] Inventor: Reginald E. Saunders, P.O. Box 1116, Piscataway, N.J. 08855

[21] Appl. No.: 493,157

[22] Filed: Jun. 12, 1995

[51] Int. Cl.[6] ..... H01H 9/00

[52] U.S. Cl. ..... 335/205; 340/545

[58] Field of Search ..... 335/205–207; 340/545, 547

[56] References Cited

U.S. PATENT DOCUMENTS 4,271,338 6/1981 Rakocy ..... 200/61.71

4,677,424 6/1987 Hollinger ..... 340/547

*Primary Examiner*—Lincoln Donovan

[57] ABSTRACT

An apparatus and method is presented which allows a conventional two component surface mounted magnetic proximity switch, so attached to the window surface, to engage while the window is in either the opened or closed position. The apparatus comprises a mounting bracket which accommodates the attachment of the permanet magnet portion of the switch and rotates through an angle of 180 degrees. The method comprises the attachment of the apparatus assembly to the moveable window sash, the attachment of the magnetic contact reed switch portion to the stationary window jam, and the operation and orientation of the apparatus assembly with respect to the magnetic contact reed switch portion.

8 Claims, 2 Drawing Sheets

APPARATUS AND METHOD FOR MAGNETIC PROXIMITY SWITCH ALTERATION

FIELD OF THE INVENTION

The following invention pertains generally to magnetic proximity switches employed in burglar alarm security systems and more specifically to a means of allowing a burglar alarm security system employing window surface mounted magnetically operated proximity switches to be armed while the windows are interchangeably in either the opened or closed position.

BACKGROUND OF THE INVENTION

A typical component in most burglar alarm security systems is a magnetically operated proximity switch. These switches are comprised of two portions; a small magnetic contact reed switch and an external permanent magnet. When the magnetic contact reed switch portion is held in close proximity along side the permanent magnet portion, the reed switch contacts are maintained in a closed position allowing electrical current to flow due to the completion of an electrical circuit. When the permanent magnet portion is moved away from the magnetic contact reed switch, the contacts open breaking the electrical circuit. By mounting the magnetically operated proximity switch on a door or window, the opening of such can be detected and register by a burglar alarm security system. There are two types of magnetically operated proximity switches. One is a surface mounted type. The other is a recessed mounted type. The surface mounted type is the easier to install of the two because it attaches to the door or window surface with conventional fastening means while both portions of the recessed mounted type require countersank holes often ¾ to 1 inch in depth. The surface mounted magnetically operated proximity switch used primarily on windows is installed by attaching the magnetic contact reed switch portion to the stationary window jam and the permanent magnet portion to the movable window sash. The proximity switch is installed with both portions in close proximity when the window is in the closed position. Therefore when the window is opened, the contacts of the switch are opened and the open circuit condition is detected by the burglar alarm security system.

The foregoing burglar alarm security system operates satisfactorily until the need for one or more of the windows to remain partially open. Once this situation occurs, the burglar alarm security system cannot be activated because the alarm will sound immediately when the open circuit condition due to the open window(s) is detected.

A possible way of addressing the problem would be to reposition the permanent magnet portion of the magnetically operated proximity switch such that the permanent magnet and the magnetic reed switch portions are in close proximity when the window is in the opened position. However, this will not suffice when the converse situation arises requiring the same window(s) to remain closed while the burglar alarm security system is operational.

Another approach would be to install two permanent magnet portions on the same window sash. The first positioned to be in close proximity to the magnetic reed switch portion when the window is in the closed position and the second positioned to be in close proximity to magnetic reed switch portion when the window is in the partially opened position. Cost wise, this is unacceptable since the magnetic reed s witch and external permanent magnet portions are sold in pairs. Two permanent magnet portions would be needed per window leaving one unused magnetic reed switch per window.

Some burglar alarm security systems provide a mechanism which allows the selective by-passing of all or part (i.e. particular window(s)) of the closed detection circuit. The window(s) could then remain open, however, no intrusion detection would be present for that particular window(s).

No prior art apparatus or method exists utilizing magnetically operated proximity switches in a burglar alarm security system which provides a practical and economic means to enable such a system to supply intrusion detection while windows of the system are interchangeably either in an opened or closed position.

SUMMARY OF THE INVENTION

The present invention provides an apparatus and method for altering the orientation of the external permanent magnet portion of a window surface mounted magnetic proximity switch such that the magnetic contact reed switch portion mounted on the stationary window jam and the permanent magnet portion mounted on the moveable window sash come in close proximity when the window is in either the opened or closed position. This is accomplished by attaching the external permanent magnet portion of a window surface mounted magnetic proximity switch to a mounting bracket. One end of the bracket is moveably attached by fastening means to the window sash through an opening in the bracket forming a sliding pivotal means. The other end of the bracket is thereby enabled to swing in an arc through an angle of 180 degrees. An opening in the swinging end of the bracket enables said end to be releasably attached to the window sash in either an upward or downward orientation by fastening means. The upward orientation of the bracket enables the external permanent magnet portion to come in close proximity to the magnetic contact reed switch when the window is in the closed position. The downward orientation of the bracket enables the external permanent magnet portion to come in close proximity to the magnetic contact reed switch when the window is in the opened position.

One advantage of the present invention is that it allows a burglar alarm security system, monitoring a window via a a surface mounted magnetic proximity switch, to be activated regardless of whether the window is in an initially opened or closed position.

Another advantage of the invention is that it allows the external permanent magnet portion and magnetic reed switch portion of a window surface mounted proximity switch to be in close proximity when the window is in an opened or closed position without having to alternately change the fixly mounted position of the external permanent magnet portion of the switch.

Yet another advantage of the invention is that it allows the external permanent magnet portion and the magnetic reed switch portion of a window surface mounted magnetic proximity switch to be in close proximity when the window is in the opened or closed position without having to employ two external permanent magnetic portions such that one is aligned for the opened and the other aligned for the closed window position.

Another advantage of the present invention is that it allows a burglar alarm security system, monitoring a window via a surface mounted proximity switch, to be activated regardless of whether the window is in an initially opened or closed position without comprising the security of the window by by-passing intrusion detection altogether.

Other and further advantages will be obvious upon examining the following detailed description.

DETAILED DESCRIPTION

Figure 1:
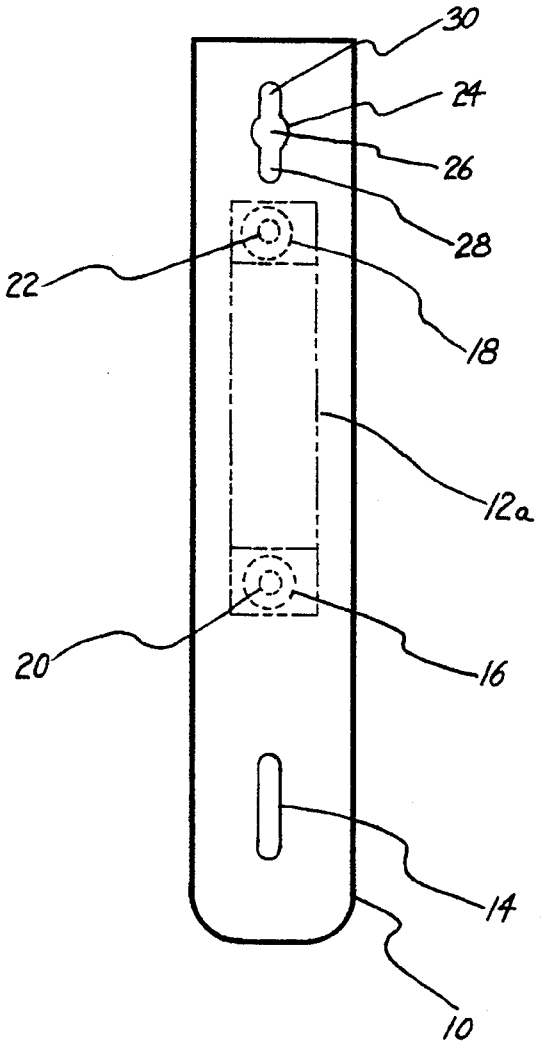
FIG. 1 is a top view of an apparatus for altering the orientation of the permanent magnet portion of a conventional window surface mount magnetic proximity switch in accordance with the present invention.

Referring to FIG. 1, the mounting apparatus is typically comprised of a flat elongated member forming a mounting bracket 10 accommodating the external permanent magnet portion 12*a* of a window surface mounted magnetic proximity switch. Said mounting bracket 10 being composed of a transparent resilient material, in the preferred embodiment, containing a plurality of openings located on various portions thereof. The first of said openings 14 is elongated such that it forms a slot wide enough to accept the shaft yet narrow enough to restrict the passage of the head of a fastening means. The second and third of said openings 16 and 18 are situated on said mounting bracket such that there is a coincidence with the mounting openings 20 and 22 of the external permanent magnet portion 12*a* of a conventional window surface mounted magnetic proximity switch. The fourth of said openings 24 is comprised of a dominant central portion 26 having a dimension wide enough to allow the passage of the head of a fastening means, and two opposing slotted extensions 28 and 30 wide enough to accept the shaft yet narrow enough to restrict the passage of the head of a fastening means.

Figure 2:
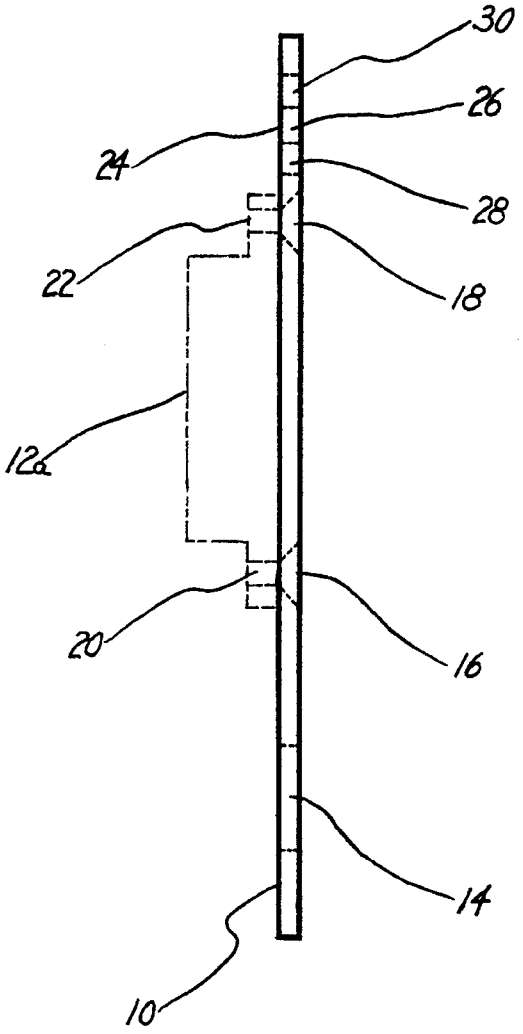
FIG. 2 is a side view of an apparatus for altering the orientation of the permanent magnet portion of a conventional window surface mount magnetic proximity switch in accordance with the present invention.

Referring to FIG. 2, the permanent magnet portion 12*a* of a window mounted magnetic proximity switch is fixedly attached to the mounting bracket 10 using conventional fastening means through said second and third openings 16 and 18 and said mounting opening 20 and 22 of the external permanent magnet portion. The mounting bracket 10 is moveably attached to the window sash surface by conventional fastening means through said first opening 14 and releasably attached to the window sash surface by conventional fastening means through said fourth opening 24.

Figure 3:
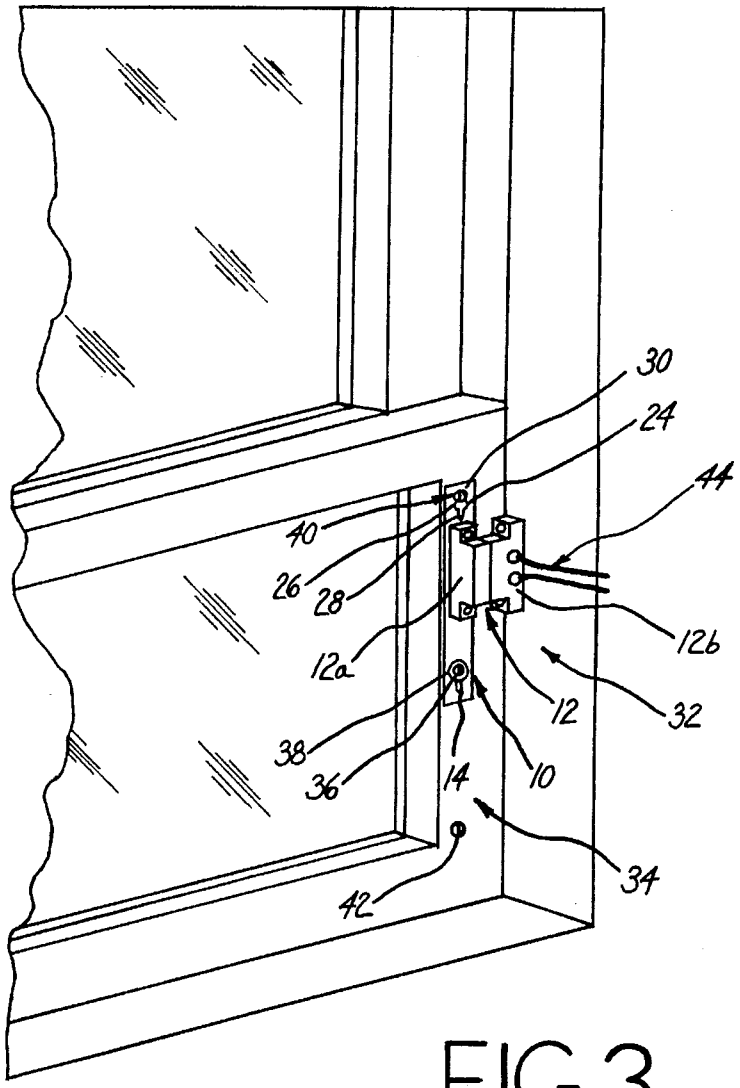
FIG. 3 is a perspective view of an apparatus for altering the orientation of the magnetic portion of a conventional window surface mounted magnetic proximity switch shown attached to the primarily operated windows sash, in closed position, alongside the magnetic reed switch portion of a window surface mounted magnetic proximity switch in accordance with the present invention.

Referring to FIG. 3, a conventional vertically tracked window assembly is shown with the primarily operated window sash 34 in closed position. Magnetic contact reed switch portion 12*b* of the window mounted magnetic proximity switch 12 is fixedly attached to window jam 32 adjacent to the distal portion of the primarily operated window sash 34 by conventional fastening means. The permanent magnet portion 12*a* of the magnetic proximity switch 12 attached to mounting bracket 10 is aligned along the distal portion of said window sash 34 to bring it in close proximity with the magnetic reed switch portion 12*b*. Mounting bracket 10 is moveably attached to the primarily operated window sash 34 by fastening means 36 through flat ring member 38 and said first opening 14 such that a sliding pivotal means is formed. Said sliding pivotal means enables fastening means 36 to travel the full length of said first opening 14 and mounting bracket opposing end comprising said fourth opening 24 to swing in an arc through an angle of 180 degrees. Mounting bracket 10 is releasably attached to window sash 34 by fastening means 40 such that the head of said fastening means passes through circular portion 26 and moves into slotted extension 30 of said fourth opening 24. Once fast-means 40 moves into slotted extension 30 and fastening means 38 moves into the upper-most portion of said first opening 14, the mounting bracket 10 is locked in place. Wires 44 are connected to the burglar alarm security system. Once the system is activated, movement of the primarily operated window sash 34 will cause the permanent magnetic portion 12*a* to move from close proximity with magnetic contact reed switch portion 12*b* thus triggering the alarm.

Figure 4:
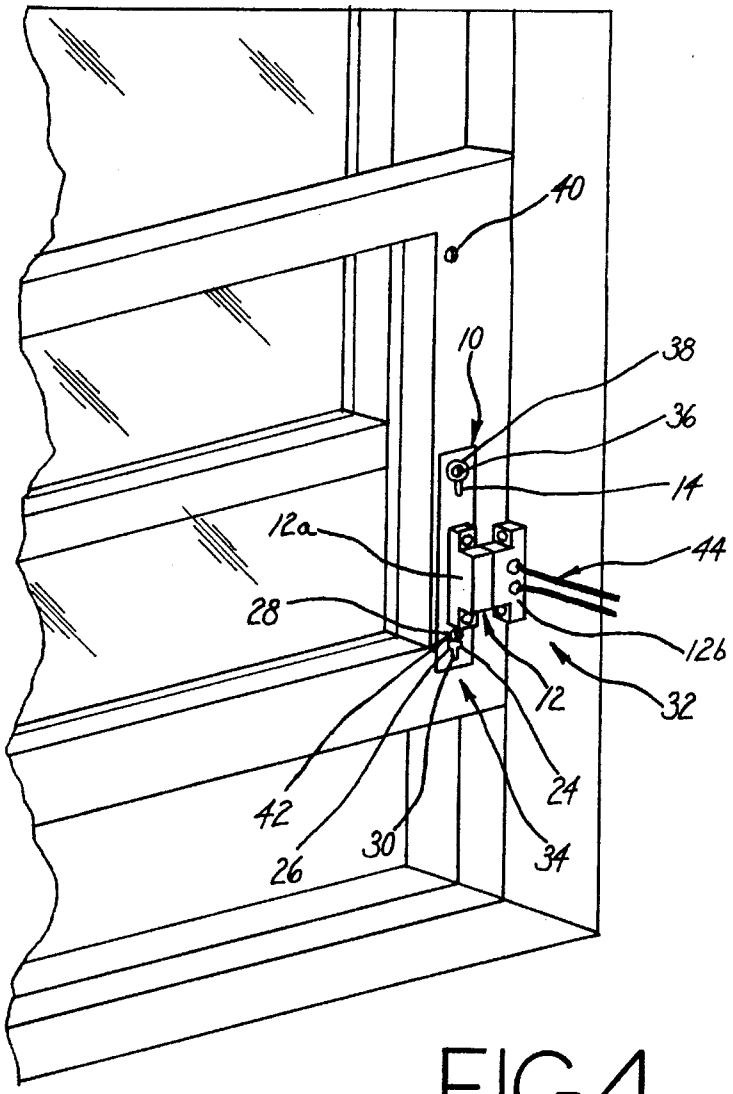
FIG. 4 is a perspective view of an apparatus for altering the orientation of the magnetic portion of a conventional window surface mounted magnetic proximity switch shown attached to the primarily operated windows sash, in opened position, alongside the magnetic reed switch portion of a window surface mounted magnetic proximity switch in accordance with the present invention.

Referring to FIG. 4, a conventional vertically hung window assembly is shown with the primarily operated window sash 34 in the opened position. Magnetic contact reed switch portion 12*b* of window mounted magnetic proximity switch 12 is fixly attached to window jam 32 adjacent to the distal portion of the primarily operated window sash 34 by conventional fastening means. The permanet magnet portion 12*a* of the magnetic proximity switch 12 attached to mounting bracket 10 is moveably attached to the primarily operated window sash 34 by fastening 36 through flat ring member 38 and said first opening 14 as described in foregoing paragraph. Mounting bracket 10 is released from attachment to window sash by fastening means 30 through said fourth opening 24 and mounting bracket opposing end comprising said fourth opening 24 is rotated in an arc through an angle of 180 degrees such that the permanent magnet portion 12*a* is brought in close proximity with the magnetic contact reed switch portion 12*b*. Mounting bracket 10 is releasably attached to window sash 34 by fastening means 42 such that the head of said fastening means passes through circular portion 26 and moves into slotted extension 28 of said opening 24. Once fastening means 42 moves into slotted extension 28 and fastening means 38 moves into the lower-most portion of said first opening 14, the mounting bracket 10 is locked into place. Wires 44 are connected to the burglar alarm security system. Once the system is activated, movement of the primarily operated window sash 34 will cause the permanent magnet portion 12*a* to move from close proximity with magnetic contact reed switch portion 12*b* thus triggering the alarm.

I claim:

1. An apparatus for altering the orientation of the permanent magnet portion of a conventional window surface mounted magnetic proximity switch comprising a flat elongated member forming a mounting bracket containing a plurality of openings located on various portions thereof;

the first of said opening being elongated such that it forms a slot;

the second and third of said openings being situated in such a manner as to be coincident with the mounting openings of the external permanent magnet portion of a conventional window surface mounted magnetic proximity switch; and the fourth of said openings being comprised of a dominant central portion and two opposing slotted extensions.

2. The apparatus of claim 1 further comprising fastening means which enable the external permanent magnet portion of a conventional window surface mounting magnetic proximity switch to be fixedly attached to said mounting bracket through said second and third openings.

3. The apparatus of claim 2 further comprising fastening means and flat ring member which enables said mounting bracket to be moveably attached to the sash of a window through said first opening such that a sliding pivotal means is formed; said sliding pivotal means enabling the fastening means to travel the full length of said first opening and the mounting bracket opposing end to swing in an arc through an angle of 180 degrees.

4. The apparatus of claim 3 further comprising fastening means enabling said mounting bracket to be releasably attached to the sash of a window through said fourth opening such that said fastening means passes through the central portion of said fourth opening and moves into one of the slotted extension portions locking said mounting bracket in place.

5. A method for altering the orientation of the permanent magnet portion of a conventional window surface mounted magnetic proximity switch comprising the step of providing a mounting apparatus comprised of a flat elongated member forming a mounting bracket containing a plurality of openings located on various portions thereof;

the first of said opening being elongated such that it forms a slot;

the second and third of said openings being situated in such a manner as to be coincident with the mounting openings of the external permanent magnet portion of a conventional window surface mounted magnetic proximity switch; and the fourth of said openings being comprised of a dominant central portion and two opposing slotted extensions, fastening means which enable the external permanent magnet portion of a conventional window surface mounted magnetic proximity switch to be fixedly attached to said mounting bracket through said second and third openings, fastening means and flat ring member which enables said mounting bracket to be moveably attached to the sash of a window through said first opening such that a sliding pivotal means is formed; said sliding pivotal means enabling the fastening means to travel the full length of said first opening and said mounting bracket opposing end to swing in an arc through an angle of 180 degrees, and fastening means which enables said mounting bracket to be releasably attached to the sash of a window through said fourth opening such that said fastening means passes through the central portion of said fourth opening and moves into one of the slotted extension portions thus locking the mounting bracket in place.

6. The method of claim 5 further comprising the steps of fixedly attaching the magnetic reed switch portion of a window surface mounted magnetic proximity switch to the window jam adjacent to the distal portion of the primarily operated window sash.

7. The method of claim 6 further comprising the steps of moving the primarily operated window sash to the closed position, aligning along the distal portion of said window sash the permanent magnet portion of the magnetic proximity switch attached to said mounting bracket with the magnetic reed switch portion of the magnetic proximity switch attached to said window jam such that the latter is in close proximity with the former, moveably attaching said mounting bracket to the primarily operated window sash by fastening means through said flat ring member and said first opening, and releasably attaching said mounting bracket to the primarily operated window sash by fastening means through said fourth opening.

8. The method of claim 7 further comprising the steps of releasing said mounting bracket from the attachment to the primarily operated window sash through said fourth opening, rotating said mounting bracket end containing said fourth opening through an angle of 180 degrees, releasably attaching said mounting bracket to the primarily operated window sash by fastening means through said fourth opening, and moving the primarily operated window sash to a partially opened position such that the permanent magnet portion of the magnetic proximity switch attached to said mounting bracket and the magnetic reed switch portion of the magnetic proximity switch attached to said window jam are in close proximity.

* * * * *